US005255058A

United States Patent [19]

Pinhas et al.

[11] Patent Number: 5,255,058

[45] Date of Patent: Oct. 19, 1993

[54] LIQUID DEVELOPER IMAGING SYSTEM USING A SPACED DEVELOPING ROLLER AND A TONER BACKGROUND REMOVAL SURFACE

[75] Inventors: Hanni Pinhas, Holon; Udi Chatow, Petach Tikva; Alon Gazit, Givataim; Ishaiau Lior, Nes Ziona; Yehuda Niv, Rehovot, all of Israel

[73] Assignee: Spectrum Sciences B.V., Wassenaar, Netherlands

[21] Appl. No.: 643,497

[22] Filed: Jan. 22, 1991

[51] Int. Cl.[5] ..... G03G 15/10

[52] U.S. Cl. ..... 355/256; 118/651

[58] Field of Search ..... 355/256, 257, 258, 261, 355/307; 118/659, 660, 661, 662, 651

[56] References Cited

U.S. PATENT DOCUMENTS

| | | | |
|---|---|---|---|
| 3,276,896 | 10/1966 | Fisher | 118/661 X |
| 3,815,989 | 6/1974 | Davis | 355/256 X |
| 3,849,171 | 11/1974 | Takahashi et al. | 355/307 X |
| 3,907,423 | 9/1975 | Hayashi et al. | 355/256 |
| 3,921,579 | 11/1975 | Wright | 118/659 |
| 4,185,910 | 1/1980 | Nomura et al. | 355/303 X |
| 4,286,039 | 8/1981 | Landa et al. | 430/119 |
| 4,373,469 | 2/1983 | Kuge et al. | 118/660 X |
| 4,400,079 | 8/1983 | Landa | 355/256 |
| 4,482,241 | 11/1984 | Morow et al. | 355/257 |
| 4,502,780 | 3/1985 | Suzuki et al. | 355/305 |
| 4,522,484 | 6/1985 | Landa | 355/261 X |
| 4,676,191 | 6/1987 | Kojima et al. | 355/251 X |
| 4,794,651 | 12/1988 | Landa et al. | 430/110 |
| 4,947,201 | 8/1990 | Niv et al. | 355/256 |
| 5,019,868 | 5/1991 | Kubert et al. | 355/256 X |
| 5,034,778 | 7/1991 | Levanon et al. | 355/256 X |
| 5,084,718 | 1/1992 | Yamazaki et al. | 346/157 |
| 5,117,263 | 5/1992 | Adam et al. | 355/256 |

FOREIGN PATENT DOCUMENTS

| | | | |
|---|---|---|---|
| 0175392 | 3/1986 | European Pat. Off. . | |
| 0163563 | 12/1980 | Japan | 355/256 |
| 0081870 | 7/1981 | Japan . | |
| 0188078 | 11/1982 | Japan . | |
| 0033274 | 2/1983 | Japan | 355/256 |
| WO90/14619 | 11/1990 | PCT Int'l Appl. . | |
| WO90/08984 | 8/1990 | World Int. Prop. O. . | |
| 90/10896 | 9/1990 | World Int. Prop. O. . | |

*Primary Examiner*—A. T. Grimley
*Assistant Examiner*—Robert Beatty
*Attorney, Agent, or Firm*—Sandler, Greenblum & Bernstein

[57] ABSTRACT

Imaging apparatus having an image forming surface arranged for movement in a first direction and an image forming apparatus for forming electrostatic latent image and background areas at respective first and second electrical potentials on the image forming surface, a development apparatus biased to a third potential intermediate the first and second potentials for developing the electrostatic latent image using a liquid developer including electrically charged toner particles to form a developed image, the development apparatus having a development surface maintained in a spaced apart relationship from the image forming surface and moving in a direction opposite to the first direction, a background toner removal surface spaced from the image forming surface for the removal of toner particles from the background areas and preferably moving in a direction opposite to the first direction, and an apparatus for supplying a liquid to at least a portion of the space between the image forming surface and the additional surface.

46 Claims, 5 Drawing Sheets

LIQUID DEVELOPER IMAGING SYSTEM USING A SPACED DEVELOPING ROLLER AND A TONER BACKGROUND REMOVAL SURFACE

FIELD OF THE INVENTION

The present invention relates generally to color electrostatic imaging and particularly to apparatus for developing color electrostatic images.

BACKGROUND OF THE INVENTION

Systems for color liquid toner electrostatic image reproduction are known in the art. These systems comprise apparatus for creating a latent electrostatic image on a surface through the formation of image and background areas, apparatus for developing the latent image including contacting the latent image with a liquid toner and a background cleanup apparatus that minimizes the undesirable deposition of toner on background surfaces. The development systems described in PCT patent application WO 90/14619 employ a reverse roller as a development surface with the reverse roller voltage intermediate the voltages on the image and background regions of the latent image bearing surface. For the systems described therein the background downstream of the development roller is virtually free of carrier liquid. Other systems which do not use rollers as a development surface, such as those described in U.S. Pat. No. 4,420,244, use a reverse roller charged to a voltage intermediate the voltage on image and background areas of the surface for removal of toner particles and excess liquid from the background and for the metering of the image.

SUMMARY OF THE INVENTION

There is provided in accordance with the present invention imaging apparatus having an image forming surface arranged for movement in a first direction and an image forming apparatus for forming electrostatic latent image and background areas at respective first and second electrical potentials on the image forming surface, development apparatus for developing the electrostatic latent image using a liquid developer including electrically charged toner particles to form a developed image, the development apparatus comprising a development surface maintained in a spaced apart relationship from the image forming surface and moving in a direction opposite to the first direction, an additional surface spaced from the image forming surface for the removal of toner particles from the background areas and preferably moving in a direction opposite to the first direction, and apparatus for supplying a liquid to at least a portion of the space between the image forming surface and the additional surface.

Alternatively, in a preferred embodiment of the invention, the additional surface moves in the first direction.

In accordance with a preferred embodiment of the invention the development surface and the additional surface are charged to respective third and fourth electrical potentials which are preferably different from each other and which are intermediate the first and second electrical potentials.

In accordance with a preferred embodiment of the invention the fourth electrical potential is closer to the value of the first electrical potential than is the third electrical potential.

In accordance with still another preferred embodiment of the invention the image forming surface is a surface of a drum rotating about an axis.

In accordance with yet another preferred embodiment of the invention the development surface is the surface of a rotating roller having an axis of rotation perpendicular to the first direction.

In accordance with a further preferred embodiment of the invention the additional surface is a surface of a rotating roller having an axis of rotation perpendicular to the first direction.

In accordance with another preferred embodiment of the invention the development surface is the surface of a rotating roller having an axis parallel to the axis of the drum and wherein the rotating roller and rotating drum rotate in the same sense.

In accordance with yet a further preferred embodiment of the invention the additional surface is the surface of a rotating roller having an axis parallel to the axis of the drum and wherein the rotating roller and rotating drum rotate in the same sense.

In accordance with yet a further preferred embodiment of the invention the additional surface is the surface of a rotating roller having an axis parallel to the axis of the drum and wherein the rotating roller and rotating drum rotate in opposite senses.

In accordance with yet a further preferred embodiment of the invention a portion of the additional surface is closely spaced from the image forming surface and the portion moves in a direction which is opposite to the first direction.

BRIEF DESCRIPTION OF THE DRAWINGS

The present invention will be more fully understood and appreciated from the following detailed description, taken in conjunction with the drawings in which.

DETAILED DESCRIPTION OF PREFERRED EMBODIMENTS

Figure 1:
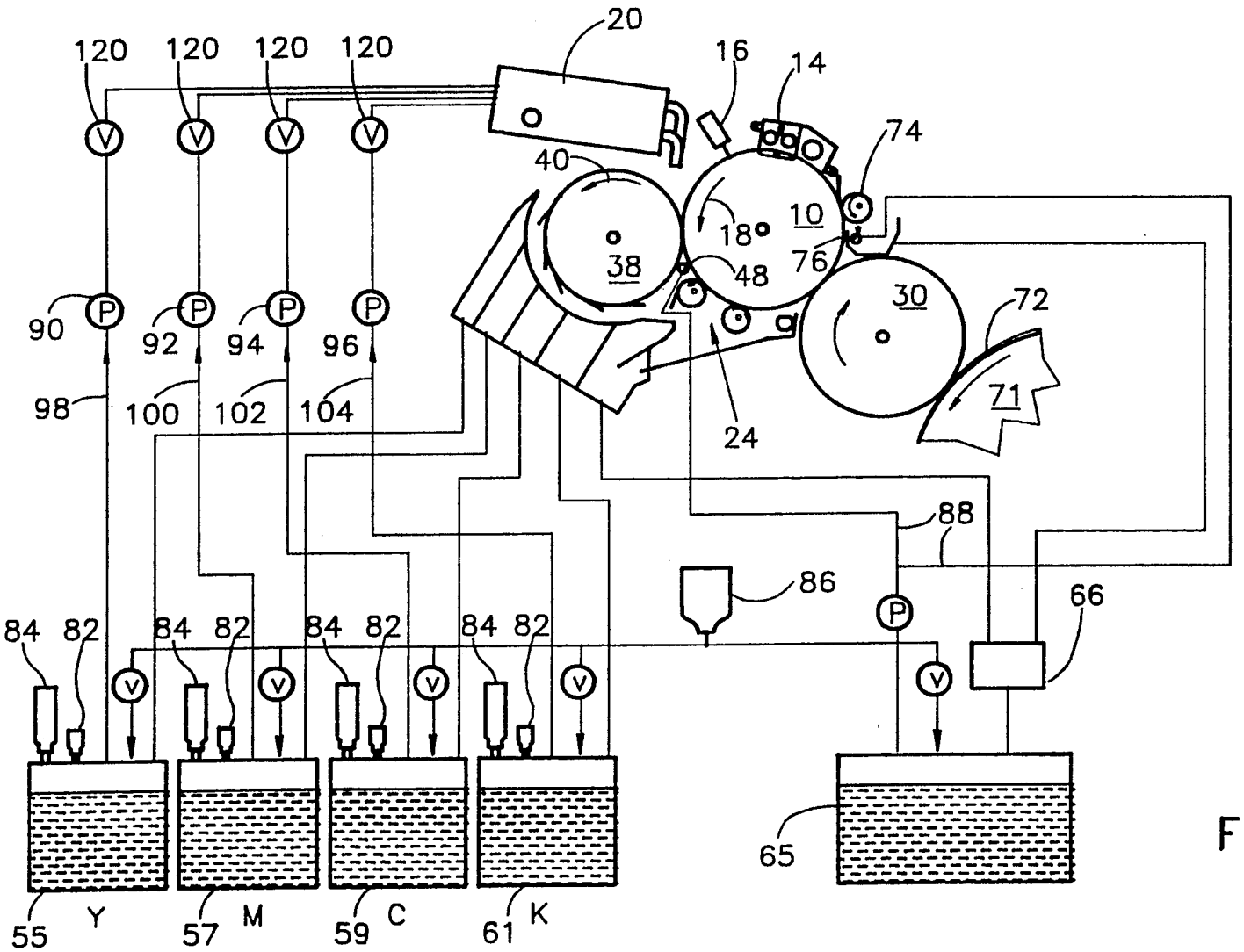
FIG. 1 is a generalized schematic illustration of an imaging system constructed and operative in accordance with a preferred embodiment of the present invention.
Figure 2:
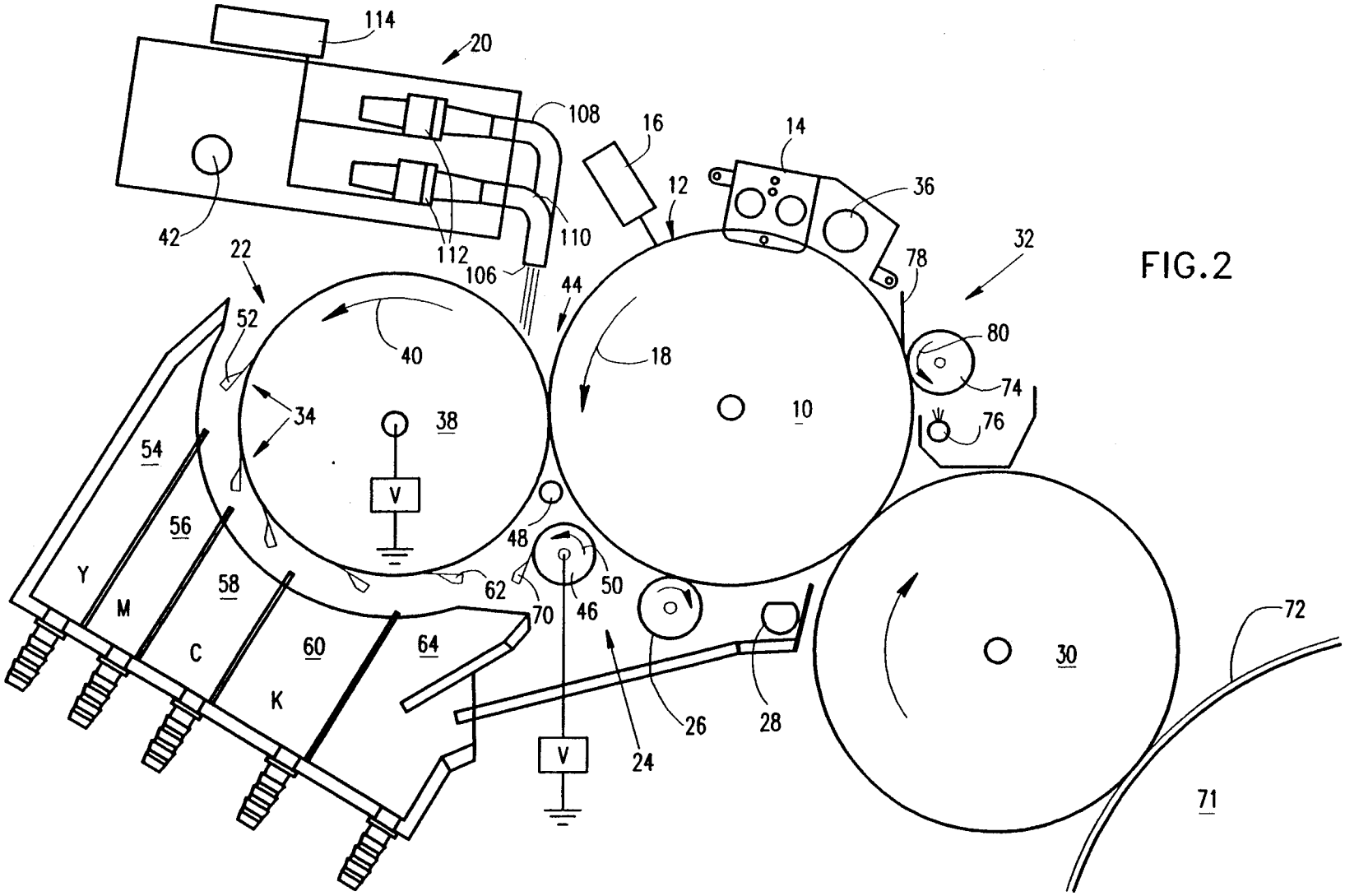
FIG. 2 is a schematic illustration of a portion of the apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an image bearing surface 12 typically embodied in a rotating photoconductive drum 10. Drum 10 is driven in any appropriate manner (not shown) in the direction of arrow 18 past charging apparatus 14, preferably a corotron, adapted to charge the surface of the photoconductive drum 10. The image to be reproduced is focused by imaging apparatus 16 upon the charged surface 12 at least partially discharging the photoconductor in the areas struck by light and forming the electrostatic latent image. Thus the latent image normally includes image areas at a first electrical potential and background areas at another electrical potential.

Photoconductive Drum 10 and photoconductor charging apparatus 14 may be any suitable drum and charging apparatus such as are well known in the art.

Imaging apparatus 16 may be a modulated laser beam scanning apparatus, an optical focusing device for imaging a copy on a drum or other imaging apparatus such as is known in the art. Alternatively, drum 10 may have a fixed electrostatic latent image thereon or may be a dielectric material onto which charge is deposited in an image form.

Also associated with photoconductive drum 10 are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and a neutralizing lamp assembly 36.

Developing assembly 22 preferably includes a development roller 38. Development roller 38 is preferably spaced from photoconductive drum 10 thereby forming a gap between development roller 38 and drum 10 which is typically 40 to 150 μm and is charged to an electrical potential intermediate that of the image and background areas of photoconductive drum 10. Development roller 38 is thus operative when maintained at a proper voltage to apply an electric field to aid development of the latent electrostatic image.

Development roller 38 typically rotates in the same sense as drum 10 as indicated by arrow 40. This rotation provides for the surface of drum 10 and development roller 38 to have opposite velocities in their region of propinquity.

Multicolor liquid developer spray assembly 20, which is described in more detail herein below, is preferably mounted on axis 42 to allow assembly 20 to be pivoted in such a manner that a spray of liquid toner containing electrically charged pigmented toner particles can be directed either onto a portion of the development roller 38, a portion of the photoconductive drum 10 or directly into a development region 44 between drum 10 and development roller 38.

Color specific cleaning blade assemblies 34 are operatively associated with developer roller 38 for separate removal of residual amounts of each colored toner remaining thereon after development. Each one of blade assemblies 34 is selectably brought into operative association with developer roller 38 only when toner of a color corresponding thereto is supplied to development region 44 by spray assembly 20. The construction and operation of cleaning blade assembly 34 is described in PCT International Publication number WO 90/14619, the disclosure of which is incorporated herein by reference.

Each of cleaning blade assemblies 34 includes a toner directing member 52 which serves to direct the toner removed by the cleaning blade assemblies 34 from the developer roller 38 to separate collection containers 54, 56, 58, and 60 and thus to prevent contamination of the various developers by mixing of the colors. The toner collected by collection containers 54, 56, 58 and 60 is recycled to a corresponding toner reservoir (55, 57, 59 and 61). A final toner directing member 62 always engages the developer roller 38 and the toner collected thereby is supplied into collection container 64 and thereafter to reservoir 65 via separator 66 which is operative to separate relatively clean carrier liquid from the various colored toner particles. The separator 66 may be typically of the type described in PCT International Publication Number WO90/10896 the disclosure of which is incorporated herein by reference.

Figure 4:
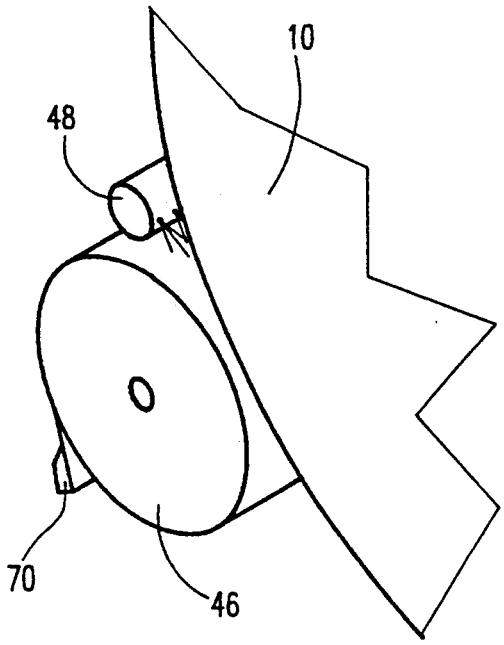
FIG. 4 is a side perspective illustration of the background cleaning station.

Background cleaning station 24, which is more clearly shown in FIG. 4, includes a reverse roller 46 and a fluid spray apparatus 48. Reverse roller 46 which rotates in a direction indicated by arrow 50 is electrically biased to a potential intermediate that of the image and background areas of photoconductive drum 10. Reverse roller 46 is preferably spaced apart from photoconductive drum 10 thereby forming a gap between reverse roller 46 and drum 10 which is typically 40 to 150 μm.

Fluid spray apparatus 48 receives liquid toner from reservoir 65 via conduit 88 and operates to provide a supply of clear non-polar liquid to the gap between photoconductive drum 10 and reverse roller 46. The liquid supplied by fluid spray apparatus 48 replaces the liquid removed from drum 10 by development assembly 22 thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via a collection container 64 and separator 66.

An electrically biased squeegee roller 26 such as that described in U.S. Pat. No. 4,286,039, the disclosure of which is herein incorporated by reference, is preferably urged against the surface of drum 10 and is operative to remove substantially all of the liquid carrier from the background regions and to compact the image and remove liquid carrier therefrom in the image regions. The squeegee roller 26 is preferably formed of resilient slightly conductive polymeric material, and is charged to a potential of several hundred to a few thousand volts with the same polarity as the polarity of the charge on the toner particles.

Discharge device 28 is operative to flood the drum 10 with light which is operative to discharge the voltage remaining on drum 10 mainly to reduce electrical breakdown and improve transfer of the image to intermediate transfer member 30.

Intermediate transfer member 30 may be any suitable intermediate transfer member such as those described in PCT International Publication WO 90/08984 the disclosure of which is incorporated herein by reference, and is maintained at a suitable voltage and temperature for electrostatic transfer of the image thereto from the image bearing surface and therefrom to a final substrate 72. Intermediate transfer member 30 is preferably associated with a pressure roller 71 for transfer of the image onto a final substrate 72, such as paper, preferably by heat and pressure.

Cleaning apparatus 32 is operative to scrub clean the surface of photoconductive drum 10 and includes a cleaning roller 74, a sprayer 76 to spray a non polar cleaning liquid to assist in the scrubbing process and a wiper blade 78 to complete the cleaning of the photoconductive surface. Cleaning roller 74 which may be formed of any synthetic resin known in the art for this purpose is driven in a direction of rotation opposite to that of drum 10 as indicated by arrow 80. Any residual charge left on the surface of photoconductive drum 10 is removed by flooding the photoconductive surface with light from neutralizing lamp assembly 36.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is transferred to the substrate after its formation. In this case the substrate is fed through the machine once for each color or is held on a platen and contacted with intermediate transfer member 30 during image transfer. Alternatively, the intermediate transfer member is omitted and the developed single color images are transferred sequentially directly from drum 10 to substrate 72.

Figure 3:
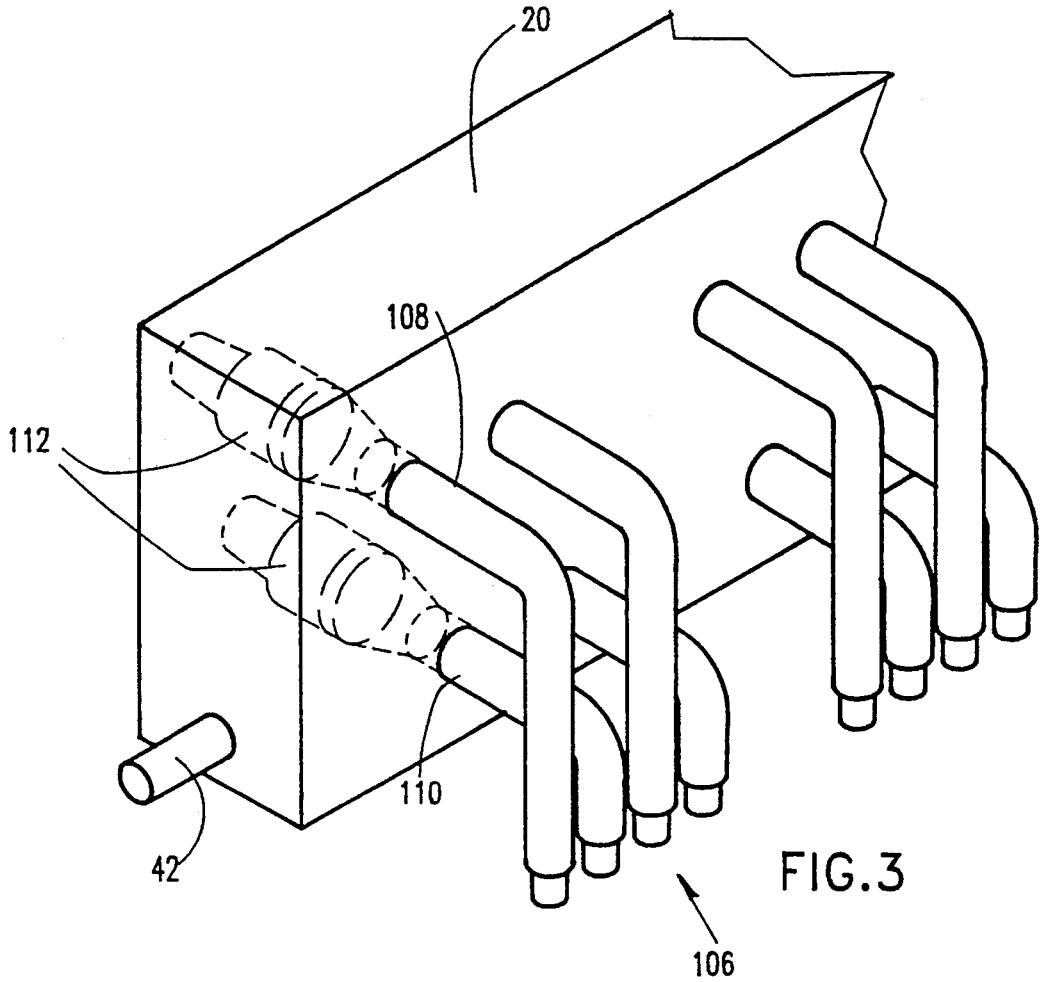
FIG. 3 is a front perspective illustration of a pivotable multicolor liquid developer spray assembly.

Reference is now made additionally to FIGS. 1, 2 and 3 in which it is seen that the multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and optionally Black respectively. Pumps 90, 92, 94 and 96 may be provided along respective supply conduits 98, 100, 102 and 104 for providing a desired amount of pressure to feed the colored toner to multicolor spray assembly 20. Alternatively, multicolor toner spray assembly 20, which is preferably a three level spray assembly, receives supplies of colored toner from six different reservoirs (not shown) which allows for custom colored tones in addition to the standard process colors.

Associated with each of reservoirs 55, 57, 59, and 61 are typically provided containers of charge director and toner concentrate, indicated respectively by reference numerals 82 and 84 as well as a supply of carrier liquid, indicated generally by reference numeral 86.

Each of the reservoirs 55, 57, 59 and 61 also typically receives an input of recycled toner of a corresponding color from developer assembly 22 as described above.

Reference is now made to FIGS. 2 and 3 which illustrate one embodiment of a multicolor toner spray assembly 20. In the embodiment of FIG. 3 it is seen that there is provided a linear array of spray outlets 106, each of which communicates with one of the four conduits 98, 100, 102, and 104. The outlets 106 leave the conduits 98, 100, 102 and 104 at one of two levels 108 and 110 to permit the minimization of separation between the outlets 106.

The spray outlets 106 are preferably interdigitated such that when four toner colors are used preferably every fourth outlet 106 sprays the same color toner and that every group of four adjacent outlets includes outlets 106 which spray four different colors. When six toner colors are used preferably every sixth outlet 106 spays the same color toner and that every group of six adjacent outlets 106 includes outlets 106 which spray six different colors.

Colored toner is sprayed under pressure from each of the outlets 106 into the development region 44. The spacing of the spray outlets 106 and their periodicity is selected to enable the toner for each individual given color to substantially uniformly fill region 44. This can result in a uniform array or preferably the colors are grouped in clusters each of which contains one outlet for each color. Typically these clusters have a center to center spacing of between 40–60 mm.

In a particular embodiment of FIG. 3 the center to center spacing between two adjacent outlets 106 in the linear array is 6.5 mm, and the spray outlets have an inner diameter of 4 mm. It may be appreciated, however, that the distance between outlets 106 may vary widely in other embodiments of the invention as long as the distribution of liquid toner is sufficient to allow for uniform development.

The flow of toner to each of the outlets 106 from conduits 98, 100, 102 and 104 is regulated by valves 112 which are controlled by controller 114. The valves 112 may be electrically controlled valves which are opened or closed by controller 114, as for example type 200 valves available from Burkert, Ingelfingen, Germany. In an alternate preferred embodiment of the invention, valves 112 are check (one-way) valves which only allow for flow toward outlets 106 and controller 114 is omitted. In a preferred embodiment of the invention a spring loaded non-return valve is used. In this preferred embodiment overall toner flow is controlled by a single valve 120 for each of the colors. In either event, the provision of valves 112 prevents siphoning which would cause dripping from the outlet after the main flow of toner is shut off. Where the toner supply to be shut off only by shutting the supply to the conduits 98, 100, 102 and 104 dripping would occur which would result in the mixing of colors, or in a long "dead" time between colors. This individual shut off of each spray outlet or the provision of check valves in each outlet allows for almost instantaneous change of developer color at the development region 44.

In any event, the amount of toner that is applied to drum 10 or development roller 38 in accordance with the present invention is sufficient to provide a layer of toner of thickness that at least substantially fills the gap between drum 10 and development roller 38.

Reference is again made to FIGS. 1 and 2 which illustrate a development assembly 22 and a reverse roller 46 constructed and operative in accordance with a preferred 21 embodiment of the invention. The development assembly 22 includes development roller 38 which operatively engages photoconductor drum 10 in spaced relationship therewith and, due to its rotation in the same sense as photoconductor drum 10, acts inter alia as a metering device. This metering effect ensures that very little liquid carries through the nip of the development region.

As noted above, it is known in the art to employ an electrically biased development roller in a liquid toner electrophotographic imaging system. The roller is charged to a suitable voltage somewhere between the voltages of image and background areas of the photoconductive drum. At such a suitable voltage the roller produces good image development without toner deposition on the background.

It has been found by the inventors that when the speed of the drum and the development roller are increased to increase the speed of operation of the system there is an unacceptable level of deposition of toner on the background surface at the boundary area between the image and background surfaces downstream of the image areas. This unwanted deposition is hereinafter referred to as "smearing".

This phenomenon appears to be the result of the dynamics of toner particle migration in the development zone 44 where an electrostatic field is set up between electrically charged development roller 38 and electrically charged image areas and background areas of drum 10. Increasing the voltage difference between background areas of drum 10 and development roller 38 decreases background smearing but, since it also decreases the voltage difference between the image areas of drum 10 and development roller 38 it also degrades the image. This image degradation appears to be caused by inhibiting migration of toner particles to the image areas of drum 10 resulting in a reduction in image optical density.

When development roller 38, maintained at a voltage which gives good developed image density, but which by itself would result in background smearing, is used in conjugation with background cleaning station 24 improved images are obtained.

Background cleaning station 24 comprises a reverse roller 46 typically maintained at a voltage difference from the background area of drum 10 which is greater than that of development roller 38. A fluid spray apparatus 48 sprays liquid toner to the region between reverse roller 46 and drum 10 to fill the gap between roller 46 and drum 10 so as to permit electrophoretic migration of toner particles from the background areas of drum 10 to reverse roller 46.

Figure 5:
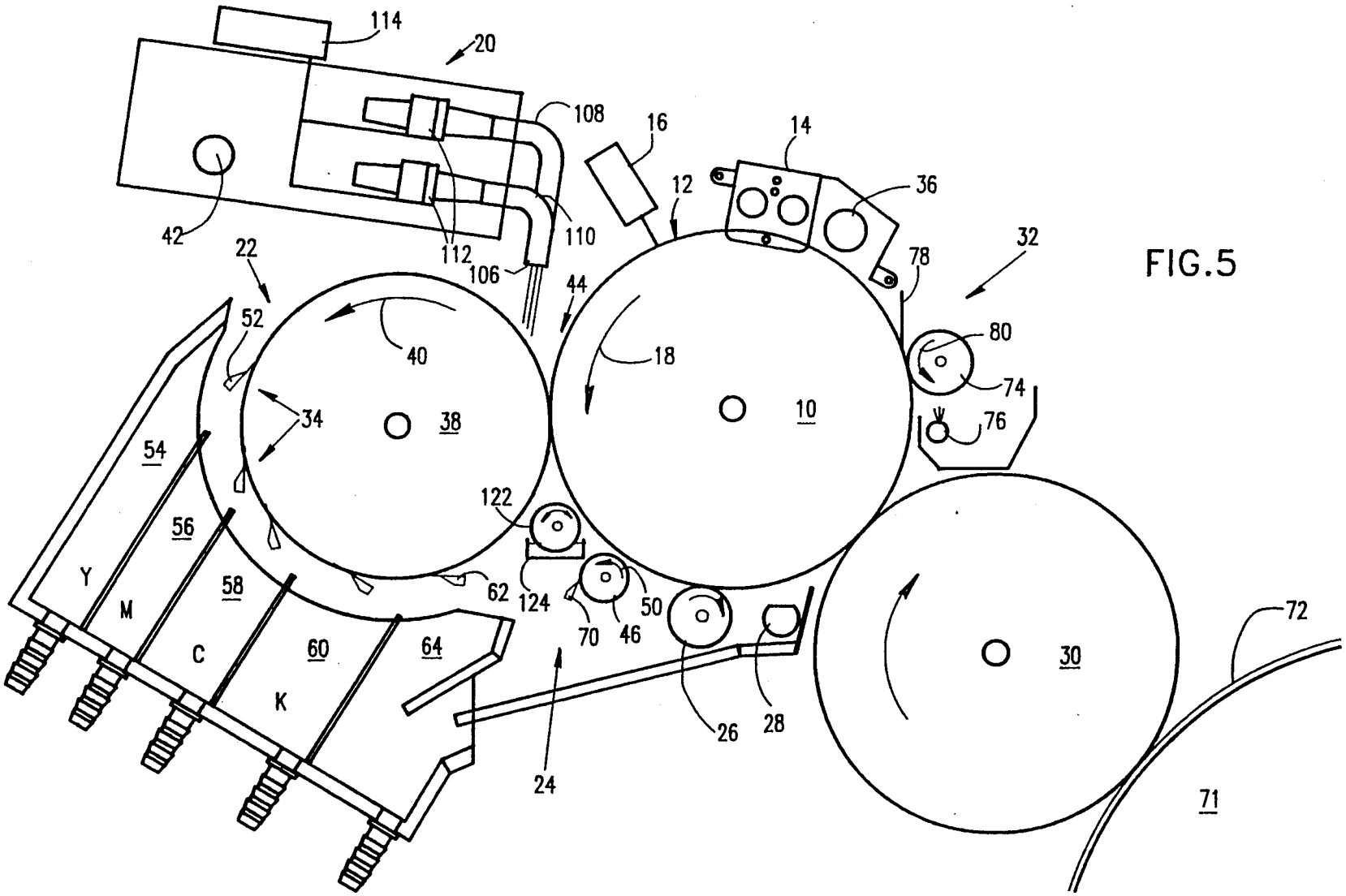
FIG. 5 is a schematic illustration of a portion of an alternative preferred embodiment of the invention.

Other means can be used for wetting this gap. For example as shown in FIG. 5, a roller 122 is partially placed in a container 124 containing clear liquid, and is rotated to pump clear liquid to the surface of drum 10. Roller 122 is either a forward or a reverse roller.

Figure 6:
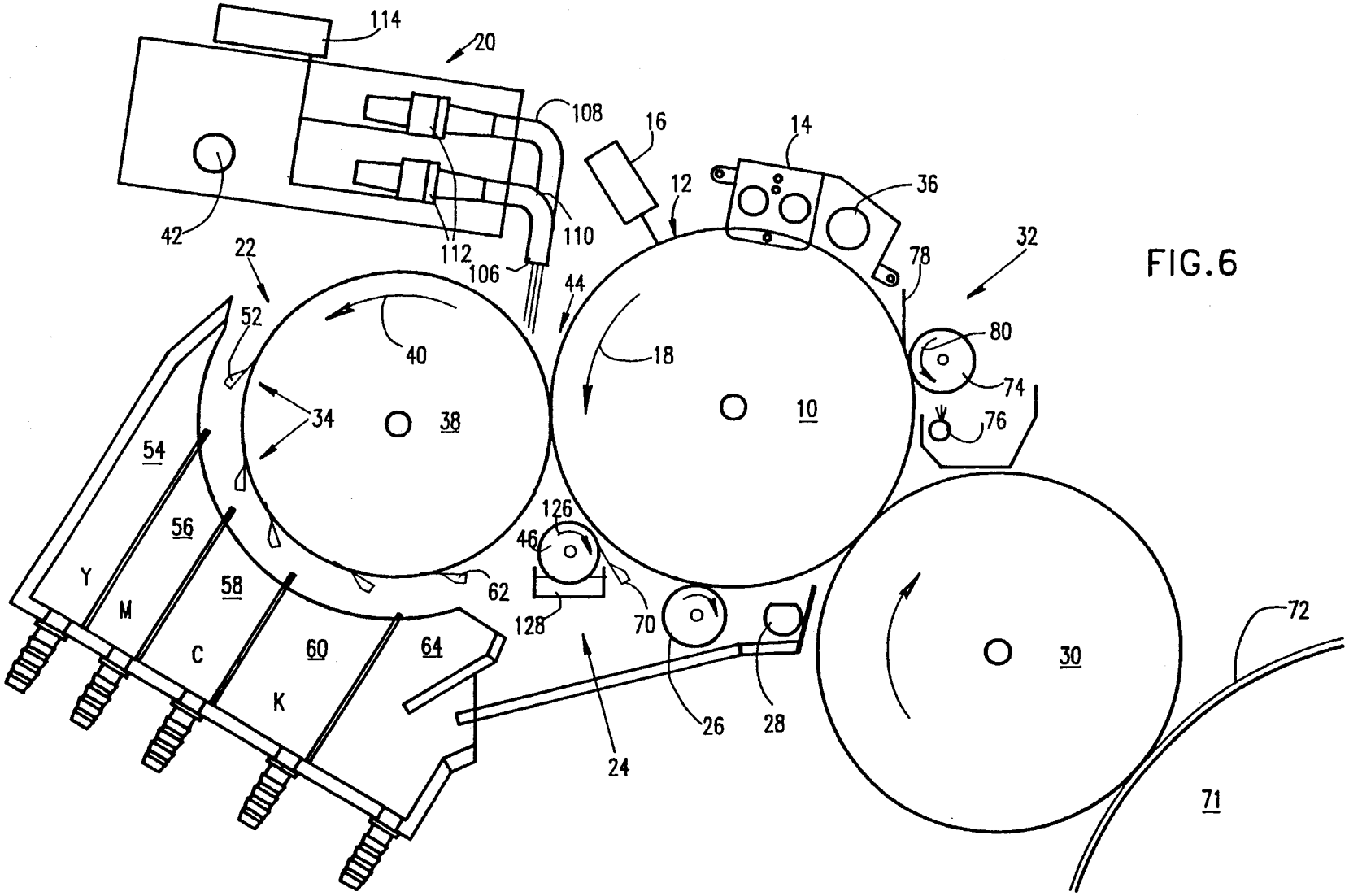
FIG. 6 is a schematic illustration of a portion of another alternative preferred embodiment of the invention.

Alternatively, as shown in FIG. 6, roller 46 is a forward roller rotating in the direction of arrow 126. Roller 46 is partially placed in a container 128, containing clear liquid and pumps same to the gap between roller 46 and drum 10. Squeegee roller 26 is then operative to remove liquid remaining on the drum therefrom.

Roller 46 is maintained at a voltage intermediate the image and background voltages so that toner particles from the image areas of drum 10 are not removed, thereby permitting operation of a color electrostatic imaging system at rates which exceed those which could previously be attained.

In a typical system operating at a process speed of 60 cm/sec, the image areas of drum 10 are at a voltage of −60 volts, the background areas are at a voltage of −1000 volts. Development roller 38 is set to a voltage of −100 volts, is spaced from drum 10 by −60 μm and has a surface speed of 100 cm/sec. Roller 46 is a reverse roller at a voltage of −150 volts, is spaced from drum 10 by 50 μm and has a surface speed of 95 cm/sec. Negatively charged toner is used in a write-black mode. These voltages and spacings are not fixed values, but depend on process speed, toner charge, mobility and viscosity, photoconductor type and image light discharge power, the spacing of the rollers from each other, and on other factors.

The above mentioned voltages are suitable for the use of negatively charged toner and an organic photoconductor drum. If it is desired to use a positively charged toner or another type of photoconductor material, correspondingly different voltages will be appropriate.

This embodiment utilizes multicolor spray assembly 20 in which the spray is directed to the development region 44 between the drum 10 and development roller 38. Alternatively the spray can be directed toward the surface of photoconductor drum 10 or either generally onto development roller 38 or more preferably toward upper surface of development roller 38. It should be noted that the rotation of development roller 38 is such as to carry the developer liquid away from a development region 44. Nevertheless the multicolor spray assembly produces a sufficient amount of force to assure that there is a supply of liquid developer at the development region.

A preferred type of toner for use with the present invention is that described in Example 1 of U.S. Pat. No. 4,794,651, the disclosure of which is incorporated herein by reference. Other toners may alternatively be employed. For colored liquid developers, carbon black is replaced by color pigments as is well known in the art.

While the invention has been described utilizing a roller developer and a drum photoconductor, it is understood that the invention can be practiced utilizing a belt developer and/or a belt photoconductor.

It will be appreciated by persons skilled in the art that the present invention is not limited by what has been particularly shown and described hereinabove. Rather the scope of the present invention is defined only by the claims which follow.

We claim:

1. Imaging apparatus comprising:

an image forming surface arranged for movement in a first direction at a development region whereat a developed visible image is formed at a given process speed using a liquid developer including electrically charged toner particles, the image forming surface having an electrostatic image including image and background areas at respective first and second potentials;

a development surface which is electrified to a third potential intermediate the first and second potentials and is spaced from the image forming surface at the development region and moves thereat;

a background toner removal surface spaced from the image forming surface for the removal of toner particles from the background areas; and means for transferring the developed image to a final substrate.

2. Apparatus according to claim 1 wherein a portion of said background removal surface is closely spaced from the image forming surface at a background removal region and said portion moves in a direction which is opposite to the first direction thereat.

3. Apparatus according to claim 1 wherein a portion of said background removal surface is closely spaced from the image forming surface at a background removal region and said portion moves in the first direction thereat.

4. Apparatus according to claim 1 wherein said background removal surface is biased to a fourth electrical potential intermediate the first and second electrical potentials.

5. Apparatus according to claim 4 wherein said third and fourth potentials are different from each other.

6. Apparatus according to claim 5 wherein said fourth electrical potential is closer to the value of said first electrical potential than is said third electrical potential.

7. Apparatus according to claim 1 wherein the image forming surface is a surface of a drum rotating about an axis.

8. Apparatus according to claim 1 wherein said development surface is the surface of a rotating roller having an axis of rotation perpendicular to the first direction.

9. Apparatus according to claim 1 wherein said background toner removal surface is a surface of a rotating roller having an axis of rotation perpendicular to the first direction.

10. Apparatus according to claim 7 wherein said development surface is the surface of a rotating roller having an axis parallel to the axis of said drum and wherein said rotating roller and rotating drum rotate in the same direction.

11. Apparatus according to claim 7 wherein said background toner removal surface is the surface of a rotating roller having an axis parallel to the axis of said drum and wherein said rotating roller and rotating drum rotate in the same direction.

12. Apparatus according to claim 7 wherein said background toner removal surface is the surface of a rotating roller having an axis parallel to the axis of said drum and wherein said rotating roller and rotating drum rotate in opposite directions.

13. Imaging apparatus comprising:

an image forming surface arranged for movement in a first direction at a development region whereat a developed visible image is formed using a liquid developer including electrically charged toner particles, the image forming surface having an electrostatic image including image and background areas at respective first and second potentials formed thereon;

a development surface which is electrified to a third potential intermediate the first and second potentials and spaced from the image forming surface at the development region and moving in a direction opposite to the first direction thereat;

a background surface toner removal surface for the removal of toner particles from the background areas, a portion of which is closely spaced from the image forming surface at a background cleaning region and which moves in a direction opposite to the first direction thereat; and means for transferring the developed image to a final substrate.

14. Apparatus according to claim 13 wherein said background removal surface is biased to a fourth electrical potential intermediate the first and second electrical potentials.

15. Apparatus according to claim 14 wherein said third and fourth potentials are different from each other.

16. Apparatus according to claim 15 wherein said fourth electrical potential is closer to the value of said first electrical potential than is said third electrical potential.

17. Apparatus according to claim 16 wherein the image forming surface is a surface of a drum rotating about an axis.

18. Apparatus according to claim 13 wherein said development surface is the surface of a rotating roller having an axis of rotation perpendicular to the first direction.

19. Apparatus according to claim 17 wherein said development surface is the surface of a rotating roller having an axis parallel to the axis of said drum and wherein said rotating roller and rotating drum rotate in the same direction.

20. Apparatus according to claim 17 wherein said background toner removal surface is the surface of a rotating roller having an axis parallel to the axis of said drum and wherein said rotating roller and rotating drum rotate in the same direction.

21. Imaging apparatus comprising:

an image forming surface arranged for movement in a first direction at a development region whereat a developed visible image is formed using a liquid developer including electrically charged toner particles, the image forming surface having an electrostatic image including image and background areas at respective first and second potentials formed thereon;

a development surface spaced from the image forming surface at the development region, biased to a third potential and moving in a direction opposite to the first direction thereat;

a background toner removal surface spaced from the image forming surface, biased to a fourth potential from said third potential for the removal of toner particles from the background areas; and means for supplying a liquid to at least a portion of the space between the image forming surface and said background toner removal surface.

22. Apparatus according to claim 21 wherein a portion of said background removal surface is closely spaced from the image forming surface at a background removal region and said portion moves in a direction which is opposite to the first direction thereat.

23. Apparatus according to claim 21 wherein a portion of said background removal surface is closely spaced from the image forming surface at a background removal region and said portion moves in the first direction thereat.

24. Apparatus according to claim 21 wherein said third and fourth electrical potentials are intermediate the first and second electrical potentials.

25. Apparatus according to claim 24 wherein said fourth electrical potential is closer to the value of said first electrical potential than is said third electrical potential.

26. Apparatus according to claim 21 wherein the image forming surface is a surface of a drum rotating about an axis.

27. Apparatus according to claim 21 wherein said development surface is the surface of a rotating roller having an axis of rotation perpendicular to the first direction.

28. Apparatus according to claim 21 wherein said background removal surface is a surface of a rotating roller having an axis of rotation perpendicular to the first direction.

29. Apparatus according to claim 26 wherein said development surface is the surface of a rotating roller having an axis parallel to the axis of said drum and wherein said rotating roller and rotating drum rotate in the same direction.

30. Apparatus according to claim 26 wherein said additional surface is the surface of a rotating roller having an axis parallel to the axis of said drum and wherein said rotating roller and rotating drum rotate in the same direction.

31. Apparatus according to claim 26 wherein said background removal surface is the surface of a rotating roller having an axis parallel to the axis of the drum and wherein said rotating roller and rotating drum rotate in opposite directions.

32. Apparatus according to claim 1 wherein the development surface moves in a direction opposite to the first direction at the development region.

33. Apparatus according to claim 13 wherein the development surface moves in a direction opposite to the first direction at the development region.

34. Apparatus according to claim 1 wherein smearing of the image takes place at the given process speed and developer voltage.

35. A method of providing an image on a substrate comprising the steps of:

providing an electrostatic image including image and background areas at respective first and second electrical potentials on an image forming surface;

moving the image forming surface in a given direction at a development region;

developing the electrostatic image using a liquid developer including electrically charged toner particles to form a developed image the step of developing utilizing a developer surface that is electrified to a potential intermediate the first and second potentials, that is spaced from the image forming surface at the development region and that is moving thereat;

removing toner particles undesirably deposited on the background region during the step of developing utilizing a background removal surface spaced from the image forming surface at a background removal region; and transferring the developed image to a final substrate.

36. A method according to claim 35 and also including the step of supplying a liquid to at least a portion of the space between the image forming surface and the background removal surface.

37. A method according to claim 35 and comprising the steps of:

closely spacing a portion of the background removal surface from the image forming surface; and moving the portion in the given direction.

38. A method according to any of claims 35 and including the step of providing the image forming surface as a surface of a drum rotating about a drum axis.

39. A method according to claim 38 wherein the background removal surface is the surface of a rotating roller having an axis parallel to the axis of the drum and including the step of rotating the rotating roller and the rotating drum in opposite senses.

40. A method according to claim 35 and comprising the steps of:

closely spacing a portion of the background removal surface from the image forming surface; and moving the portion in a direction opposite to the given direction.

41. A method according to claim 40 wherein the image forming surface is a surface of a drum and including the step of rotating the drum about a drum axis.

42. A method according to claim 41 wherein the background removal surface is the surface of a rotating roller having an axis parallel to the axis of the drum and including the step of rotating the rotating roller and the rotating drum in the same sense.

43. A method according to claim 35 wherein the developer surface is the surface of a rotating roller having an axis of rotation perpendicular to the given direction and including the step of rotating the rotating roller and the rotating drum in the same sense.

44. A method according to any of claims 35 and including the step of charging the background removal surface to a fourth electrical potential intermediate the first and second electrical potentials.

45. A method according to claim 44 wherein the third and fourth potentials are different from each other.

46. A method according to claim 45 wherein the fourth electrical potential is closer to the vale of the first electrical potential than is the third electrical potential.

* * * * *